US005901644A

United States Patent [19]

Etheridge et al.

[11] Patent Number: 5,901,644

[45] Date of Patent: May 11, 1999

[54] APPARATUS WITH REMOVABLE PRINT HEAD

[75] Inventors: John David Etheridge, Romford; Walter Herbert Henson, Hornchurch; Raymond John Herbert, Leigh-on-Sea, all of United Kingdom

[73] Assignee: Neopost Limited, Essex, United Kingdom

[21] Appl. No.: 09/084,961

[22] Filed: May 27, 1998

[30] Foreign Application Priority Data

May 28, 1997 [GB] United Kingdom ..... 9710973
Jan. 30, 1998 [GB] United Kingdom ..... 9802128

[51] Int. Cl.[6] ..... B41K 45/00

[52] U.S. Cl. ..... 101/71; 101/91; 347/49

[58] Field of Search ..... 101/71, 91; 347/49

[56] References Cited

U.S. PATENT DOCUMENTS 5,106,321 4/1992 Haroutel ..... 439/310
5,163,366 11/1992 Gregoire et al. ..... 101/91
5,170,705 12/1992 Haroutel ..... 101/91
5,427,023 6/1995 Privin ..... 101/91
5,458,431 10/1995 Ferroel-Ragotin ..... 403/322

FOREIGN PATENT DOCUMENTS 0 832 746 A1 9/1997 European Pat. Off. .

OTHER PUBLICATIONS

International Search Report.

*Primary Examiner*—Edgar Burr
*Assistant Examiner*—Dave A. Ghatt
*Attorney, Agent, or Firm*—Shoemaker and Mattare, LTD

[57] ABSTRACT

Secure printing apparatus, for example printing apparatus of a postage meter, is disclosed in which an ink jet print head with integral ink supply is removable by a user of the apparatus. In order to maintain security of the apparatus, a parking station remote from a printing station is provided for the print head and removal of the print head can be effected only at the parking station through an aperture in a secure housing at the parking station. When the print head is moved to the parking station electrical connection to the print head are disengaged from the print head and means are provided to prevent access to those electrical connections at the parking station.

18 Claims, 3 Drawing Sheets

APPARATUS WITH REMOVABLE PRINT HEAD

BACKGROUND OF THE INVENTION

This invention relates to secure printing apparatus such as is employed in postage meters in which a print head utilised for printing secure information is removably mounted on the secure printing apparatus.

Secure printing apparatus such as postage meters include electronic means for carrying out accounting functions in respect of postage values which it is desired to apply to mail items by operation of a printer. The electronic means also carries out control functions for operation of the postage meter including operation of the printer. The operation of postage meters must be carried out in a secure manner to prevent unauthorised access to critical circuits of the postage meter whereby postage indicia could be printed fraudulently. Accordingly the postage meter is housed in a secure housing which prevents unauthorised access to the postage meter or if the secure housing is breached provides indication that tampering has occurred or has been attempted. Previously the print head provided in the postage meter to print the postage indicia has been housed in the secure housing so that not only is unauthorised access to the postage meter circuits prevented or inhibited but unauthorised access to the print head and electrical connections from the postage meter to the print head is also prevented or inhibited.

Previously postage meters have been provided with a drum printer or a thermal transfer printer for printing the postage indicia. With the drum printer, ink for printing the postage indicia is supplied by means of a replaceable absorbent roller containing liquid ink which rolls in contact with print dies on the print drum. With thermal transfer printers, ink is supplied as a layer on a replaceable ribbon which is fed past a thermal print head for transfer of ink to the mail items. Both the ink roller and the ink ribbon are removable from the postage meter by a user of the postage meter for replacement by a new ink roller or ink ribbon respectively. With both of these types of printer, the printer per se is maintained secure by the secure housing. In the case of the drum printer, mechanical elements for setting the printing elements of the printer are not accessible by a user of the postage meter and in the case of a thermal transfer printer, electrical connections to the print head for control and operation of the print head are protected from access thereto.

It is now proposed, instead of drum printers or thermal transfer printers, to use ink jet printing devices. Ink jet print heads are already used widely in computer output printers where security of operation thereof is neither a problem nor required. The ink jet print heads manufactured and sold for use in computer output printers and commonly available comprise a replaceable module including a row of ink jet nozzles and means for ejecting selectively ink from those nozzles. The module also includes electronic circuits for operation of the ink ejection means and an ink supply to supply ink to the nozzles to replenish ink ejected from the nozzles in printing. When the ink in the ink supply becomes depleted the entire module including the nozzles and electronic circuits is removed and replaced by a new ink jet print head module. Since the print head must be replaced relatively frequently due to depletion of the ink supply it would be inconvenient to require replacement of the print head to be carried only by authorised service personnel in a secure manner. It is desirable to be able to use standard commonly available manufactured ink jet print heads and to permit replacement thereof to be carried out without any necessity of breaching security of the secure printing apparatus so that the print head can be replaced by users of the secure printing apparatus.

SUMMARY OF THE INVENTION

According to a first aspect of the invention secure printing apparatus includes a printing device removable by a user of the postage meter; electrical connection means interfacing with electrical contacts on the printing device when the printing device is mounted in the apparatus; a printing station in which the printing device is located to effect printing of indicia on a print receiving medium; means to locate the printing device in a parking station at which said electrical connection means do not interface with the electrical contacts and at which a user of the secure printing apparatus meter is able to remove the printing device and to substitute a replacement printing device and means isolating the parking station from said electrical connection means.

According to a second aspect of the invention secure printing apparatus includes a printing station and a parking station; a print head mounted on a carriage movable between the printing station and the parking station; a first set of electrical contacts on said print head; first means on and movable with said carriage supporting a second set of electrical contacts in electrical engagement with said first set of contacts; and second means operative when the carriage is moved from the printing station to the parking station to act on the first means such as to break the electrical engagement of the second set of electrical contacts with the first set of electrical contacts and said second means extending across the second set of electrical contacts to prevent access to said second set of electrical contacts.

The printing device may be an ink jet printing device including an ink supply.

The secure printing apparatus may be a printer of a postage meter.

BRIEF DESCRIPTION OF THE DRAWING

An embodiment of the invention will be described hereinafter by way of example with reference to the drawings in which.

DESCRIPTION OF THE PREFERRED EMBODIMENT

Figure 1:
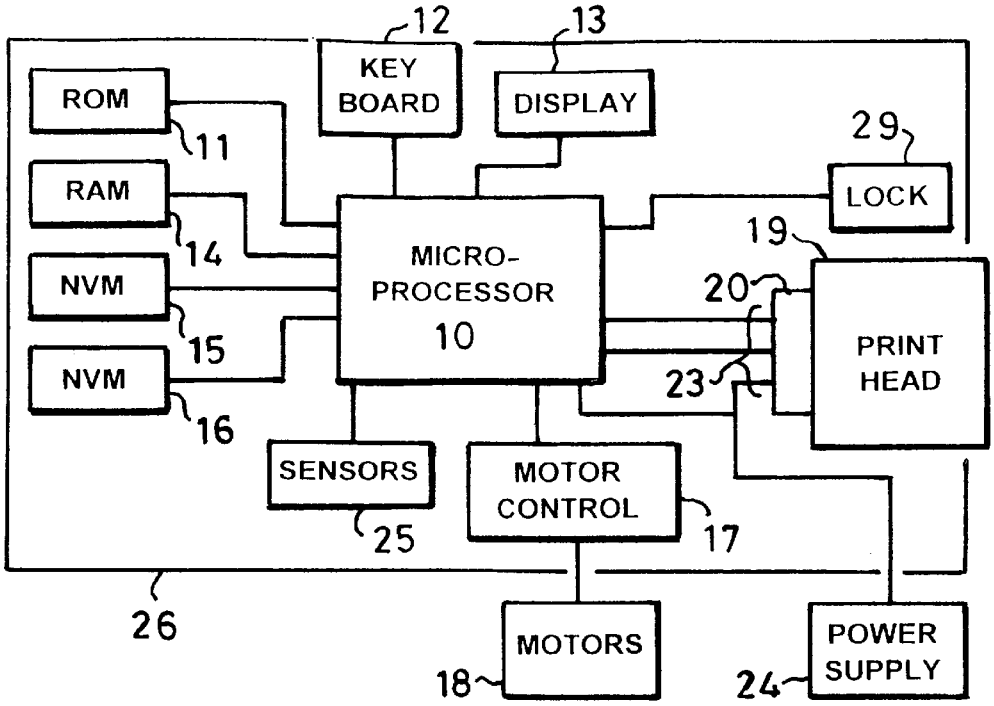
FIG. 1 is a block circuit diagram of secure printing apparatus comprising a postage meter.

Referring first to FIG. 1 of the drawings, secure printing apparatus comprising a postage meter includes electronic accounting and control means comprising a micro-processor 10 operating under program routines stored in a read only memory (ROM) 11. A keyboard 12 is provided for input of commands and data by a user and a display 13 is provided to enable display of information to the user. A random access memory (RAM) 14 is provided for use as a working store for storage of temporary data during operation of the postage meter. Non-volatile duplicated memories 15, 16 are provided for the storage of critical data relating to use of the postage meter and which is required to be retained even when the postage meter is not powered. The microprocessor 10 carries out accounting functions in relation to use of the postage meter for franking mail items with amounts of postage charges applicable to handling of the mail items by the postal authority or another carrier. Accounting data relating to use of the postage meter for printing franking indicia representing postage charges for mail items and any other critical data to be retained is stored in the non-volatile memories 15, 16. The accounting data includes a value of credit, an accumulated total of value used by the meter in franking mail items, a count of the number of mail items franked by the meter and a count of the number of mail items franked with a postage charge in excess of a predetermined value. The value of credit may be a value of credit available for use by the meter and stored in a descending credit register. The accumulated total value used by the meter is stored in an ascending tote register, the count of items is stored in a piece count register and the count of items franked with a postage charge in excess of a predetermined value is stored in a large items register. Alternatively, if desired, instead of a descending register storing a value of credit available for use by the meter, a total value of credit entered into the meter may be stored in an ascending credit register.

As is well known in the postage meter art, each of the registers referred to hereinbefore for storing accounting data is replicated in order to enable integrity of the accounting data to be maintained even in the event of a fault or termination of power to the meter during a franking operation. Two replications of each of the registers are provided in each of the memory devices 15, 16.

Figure 2:
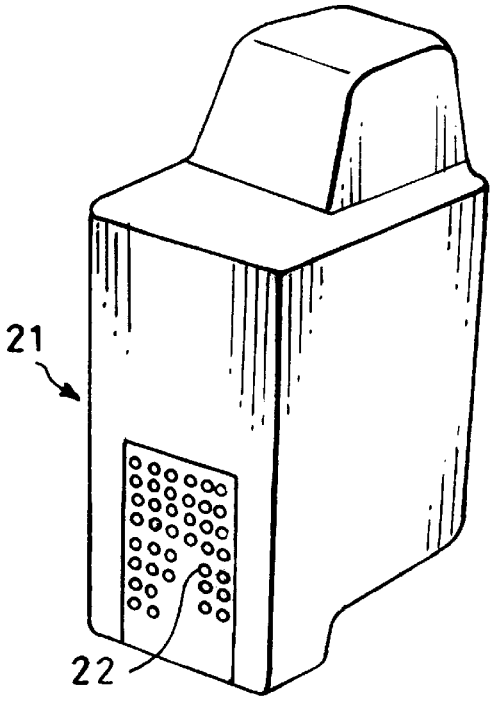
FIG. 2 illustrates a removable ink jet print head module.

A motor controller 17 is controlled by the microprocessor 10 to control operation of motors 18 driving means for transporting the print head over a print receiving area of a stationery mail item and any motors required to perform other driving operations. The digital print head 19 is a removable print head connected to the postage meter by means of a connector 20. The digital print head is preferably an ink jet print head constructed as a module 21 as shown in FIG. 2. The module is provided with a plurality of electrically conductive pads 22 which interface with conductive elements of the connector 20 when the module 21 is mounted in the postage meter. The connector 20 may be formed integrally with a ribbon cable 23 and conductive areas of the ribbon cable may be formed as the conductive elements of the connector 20 making electrical connection with the pads 22 of the print head module. The ink jet print head includes a plurality of ink ejection nozzles (not shown) from which ink may be ejected selectively by means of the operation of electronic circuits in the module. The module also contains a supply of ink to replenish ink ejected from the nozzles. The ribbon cable 23 includes a plurality of conductive tracks providing electrical paths to the print head module. The tracks of the ribbon cable carry electrical signals between the microprocessor of the postage meter and the print head module and carry electrical power from a power supply 24 to the print head module. The power supply 24 also provides electrical power to the electronic circuits of the postage meter including the microprocessor and the motor control.

Sensors 25 are provided to sense and monitor various operations or locations of elements of the postage meter including transport of the print head. The sensors provide signals to the microprocessor to enable the microprocessor to control transport of the print head and to output signals on the ribbon cable 23 to selectively operate the circuits in the print head module 22 to eject ink droplets from the nozzles at appropriate times as the print head is transported relative to the print receiving area of the mail item.

It will be appreciated, as is well known in the postage meter art, that the postage meter must operate in a secure manner and be protected from attempts to use the meter fraudulently for example by utilising the postage meter to print franking indicia on mail items for which no corresponding postage charge has been accounted for by the accounting means. Accordingly those parts of the postage meter required to be secured against unauthorised tampering are housed in a secure housing 26.

In so-called prepayment operation of a postage meter, each time a franking operation is to be performed, the microprocessor carries out a routine in which a determination is made as to whether the value of credit in the credit register in NVMs 15, 16 is sufficient to permit the franking operation in respect of the required postage charge for a mail item to be performed. If the value of credit in the credit register is sufficient, the franking operation is continued and the accounting data in the registers is updated to account for the postage charge and the franking indicia is printed. However if the value of credit in the credit register is not sufficient to permit the franking operation in respect of the required postage charge to be performed, the operation is terminated and the franking indicia is not printed. Where a value of credit available for use in franking is stored in a descending register, the check as to sufficiency of the credit available is effected by a determination of whether the postage charge is less than the credit value. Where a total value of credit is stored in an ascending credit register the check as to sufficiency of credit is effected by a determination of whether the total value of credit is at least equal to the sum of the postage amount and the accumulated total value in the tote register.

As described hereinbefore, the print head module 22 includes an integral ink supply. Accordingly when the ink supply is depleted to an extent that further operation of the print head will result in an unacceptable quality of printed impression the module 22 must be removed and replaced by a new module containing a full ink supply. Removal of the used module and replacement by a new module needs to be effected by a user of the postage meter whenever the ink supply becomes depleted as described hereinbefore. If no protection is provided, access to the conductive elements of the connector 20 or to the electrically conductive pads 22 of the print head module 21 would be possible. As a result it may be possible for any person with a fraudulent intent to effect access to the conductive elements of the connector 20 or to the pads 22 of the module and thereby cause improper operation of the postage meter or of the print head 19. Fraudulent printing of postage indicia for which accounting has not been carried out might be able to be effected.

In order to prevent attempts to operate the postage meter or the print head fraudulently by gaining access to the electrical connections between the postage meter and the print head module, unauthorised access to the print head module during operation of the print head module to print postage indicia is barred by the secure housing 26 and limited access only for replacement of the print head module 22 is provided via an aperture 27 in the secure housing which is closable by a hatch cover 28. The cover may be locked in a closed position by an electronically operable lock 29 operable by the microprocessor 10. It will be appreciated that the aperture 27 permits only sufficient access to permit replacement of the print head module and the secure housing is so constructed as to prevent unauthorized access to any other part of the postage meter that is required to be maintained secure. In order for a user to gain access to the print head module for the purpose of replacement of the module, the cover 28 must be opened. If the cover is locked by a lock, the lock preferably operates mechanically and automatically to secure the cover in the closed position when the cover is moved to the closed position. The lock may be unlocked to release the cover by means of the operation of a solenoid or motor under the control of the microprocessor 10 in response to operation by the user of a key of the keyboard. One of the sensors 25 may be responsive to the cover 28 being in the closed in order to inhibit operation of the postage meter except when the cover 28 is fully closed and, if a lock 29 is provided, to inhibit operation of the postage meter except when the cover 28 is locked in the closed position.

The nozzles of commonly available print heads are capable of printing only over an extent less than that required to print a postage indicium on a mail item. Therefore the module 22 is removably mounted on a carriage that is driven by one or more of the motors 18 in a reciprocating manner such that the nozzles of the module are traversed along a first track and a second track offset relative to the first track in a printing station 32 across an area of a mail item that is to receive a postage indicia imprint. The traversal of the print head module in the printing station 32 during a printing operation to print a postage indicium is between limit positions indicated as 30 and 31 in FIG. 4. The ribbon cable 24 is flexible and provides electrical connections to the print head module during the traversal movement of the print head module in the printing station to provide print head drive signals and power to the print head during a printing operation.

The removable mounting of the print head module in the carriage is arranged such that the print head module can be released from its mounting on the carriage while still within the secure housing 26 when displaced to a parking station 33 within the secure housing by the print head transport means. The parking station 33 is located outside the operational range of movement of the print head module in the printing station 32 such that, when the print head module is located in the parking station, the print head module is accessible through the opening 27 in the secure housing 26. The end of the ribbon cable 23 at which the conductive elements mating with the pads 22 of the module 21 are located is secured to the carriage. When the print head module is mounted on the carriage the pads 22 mate in face to face contact with the conductive elements of the ribbon cable. When the print head module is released from the carriage the face to face mating of the conductive elements and pads 22 is broken and the print head module is disconnected from the remainder of the circuits of the postage meter. Thus the module 21, when moved to the parking station is not connected to the postage meter and no part of the ribbon cable is accessible at the parking station through the opening 27. The parking station is sufficiently remote from the range of operating positions of the print head module in the printing station as to prevent or at least greatly impede any access to the ribbon cable or other electrical connections to the module when the print head module is in the printing station.

When the print head module is moved by the carriage into the parking station, the print head module in which the ink supply has become exhausted may be withdrawn from the carriage through the opening 27 and a replacement module may be inserted through the opening 27 into the carriage. After insertion of the replacement module into the carriage, the print head transport means is operated to move the module to the printing station. Operation of the module print head transport means to move the module to the printing station is preferably dependent upon the cover 28 being in its closed position and, where a lock is provided for the cover, be dependent upon the cover being in the closed position and locked in the closed position.

While the separation of the parking station from the operating location of the module provides a substantial protection against unauthorised access to the electrical connections to the print head module additional protection may also be provided. For example instead of moving the print head module along a straight line path between the printing and parking stations, the print head module may be moved through a more complex path consisting for example of an arcuate path or a path in which sections of the path meet at a significant angle. The angle may 90° but may be lesser or greater. Additional security may also be provided by the provision of a closure member located between the parking station and the printing station. The closure member may comprise a shutter 34 or the like which closes the path between the parking station and the printing ;station except during movement of the module between the stations. The closure member may be provided with cutting means operative to sever foreign elements extending through the opening 27 into the operating station. For example an attempt may be made to insert a module to which illicit electrical connections to an external device are attached with the intention of moving the module into the printing station and thereby making electrical connections for conveying print head drive signals to the external device. An interlock sensor may be provided to inhibit operation of the postage meter unless the closure member is fully closed. Attempts to provide a connection to an external device as described hereinbefore would prevent the closing of the closure member and therefore inhibit operation of the postage meter. Furthermore if the closure member is provided with cutting means, closing of the closure member could result in severing of the illicit connection to the external device or electrical shorting of the illicit connections thereby preventing fraudulent operative use of the illicit connections.

The movement of the module between the parking station and the printing station may be accomplished as described hereinbefore by means of the print head module transport means driven by an electric motor controlled by the microprocessor. Similarly the closure member may be opened and closed by a motor controlled by the microprocessor. Alternatively parking means may be provided that are separate from and operative independently of the print head transport means. The parking means may be constructed to move the carriage in which the print head module is mounted between the printing and parking stations or the carriage may remain in the printing station and the parking means be constructed and arranged to extract the print head module from the carriage and convey only the print head module to the parking station. The parking means would also be constructed and arranged to convey a replacement print head module from the parking station to the printing station and to insert the replacement print head module into the carriage. The parking means may be a manually operated mechanism to move the module and to operate the closure member, the mechanism being so constructed that the closure member is normally in its closed position and is opened only when the module is moved between stations.

As described hereinbefore, the parking station is located remote from the printing station however if desired the parking station may be coincident with a position of the module when in the printing station. The carriage may be utilised to move the module to the parking station, the module is then retained at the parking station by retaining means (not shown) and the carriage, or a part thereof carrying electrical connections, is moved away from the module so as to release the module from the carriage and at the same time break the connection between the module and the ribbon cable. The closure member is then moved into a position such that the closure member is located between the module in the parking station and the ribbon cable thereby securely isolating the parking station from the remainder of the postage meter. When the parking station is, isolated by the closure member the cover 28 may be opened to permit replacement of the module. Interlocks are provided to ensure that the cover 28 cannot be opened except when the parking station is isolated by the closure member.

Figure 5:
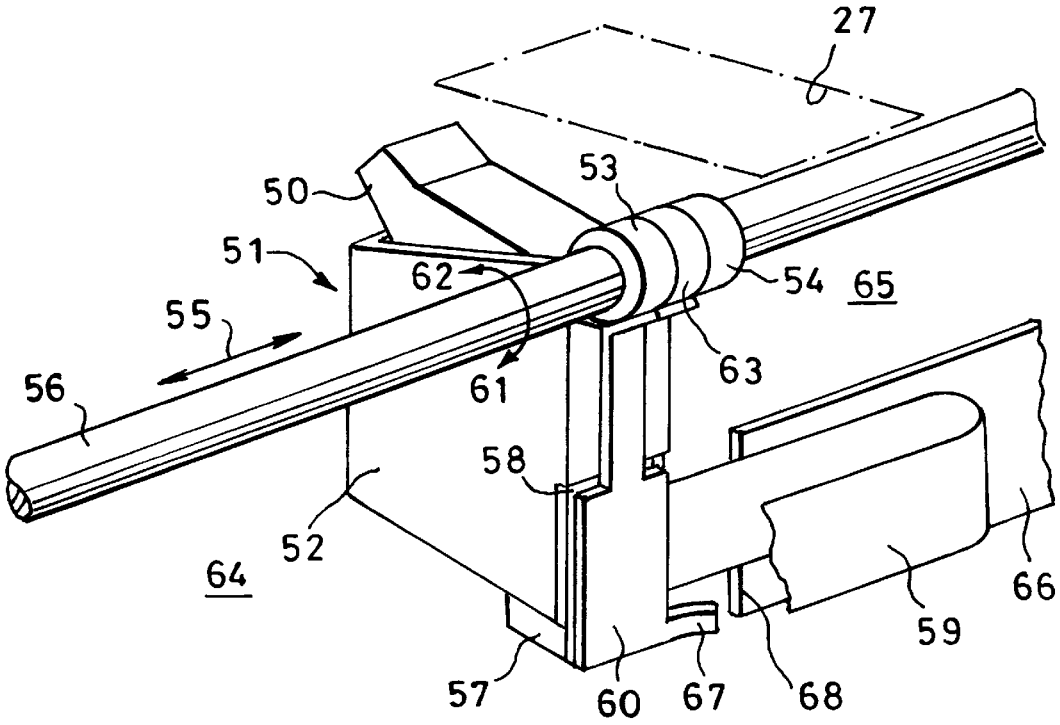
FIG. 5 illustrates a construction of carriage for the print head and means for preventing access to electrical connections between the print head and the electronic circuits of the postage meter.

Referring now to FIG. 5, of the drawings, an ink jet print head module in the form of a cartridge 50 is removably mounted in a carriage 51. The carriage 51 includes a receptacle 52 for the print head cartridge 50 and bearing elements 53, 54 to support the carriage for translational movement in a direction indicated by arrow 55 along a guide rod 56. The print head cartridge 50 has a nose portion 57 in which ink jet nozzles are located and the nose portion projects from the receptacle 52. A region of the print head cartridge is provided with a first set of electrical contacts, as described with reference to FIG. 2 to enable electrical signals and electrical power to be input to the print head cartridge to control operation of the ink jet print head. The first set of electrical contacts are aligned with an aperture 58 in the receptacle 52. Electrical signals are carried between the print head and electrical circuits of the postage meter by means of a flexible ribbon cable 59. An end of the ribbon cable carries a second set of electrical contacts corresponding to the first set of electrical contacts on the print head cartridge and the end of the ribbon cable is secured to a member 60. The member 60 is pivotally mounted relative to the carriage 51 whereby pivotal movement of the member in a first direction, indicated by arrow 61, brings the two sets of electrical contacts into electrical engagement with one another and whereby pivotal movement of the member in an opposite second direction, indicated by arrow 62, separates the two sets of electrical contacts. Conveniently the member 60 is pivoted by means of a bearing 63 located between the bearings 53, 54 mounted on the guide rod 56. Spring means (not shown) are provided to urge the member 60 in the first direction to maintain the two sets of electrical contacts in electrical engagement during normal operation of the print head.

The print head cartridge includes an ink supply for the print head and hence periodically when the ink supply becomes depleted it is necessary to replace the cartridge by removal of the used cartridge and insertion of another cartridge having a sufficient supply of ink. It will be appreciated that when the print head cartridge 10 is removed for replacement thereof, the electrical contacts of the second set on the end of the ribbon cable 59 are exposed through the aperture 57 and it would be possible for unauthorised electrical connections to be made to those contacts for fraudulent purposes.

The mounting of the print head carriage 51 on the guide rod 56 permits translational movement of the nozzles of the print head in the direction indicated by arrow 55 parallel to the length of the guide rod 56. Accordingly translational movement of the carriage in a print station, indicated by reference 64, over a range of movement results in the nozzles being scanned over a print receiving area of a print receiving medium such as a mail item. The nozzles of the print head are disposed in one or more columns extending perpendicular to the direction of movement of the carriage and hence by repeated selective operation of the nozzles during the movement of the carriage in the printing station an ink impression is deposited column by column in the print receiving area. As shown in the drawing the print head carriage 51 is located in the printing station at one end of the print range of movement in the printing station.

When it is desired to remove the print head cartridge 50, for example when the ink supply of the cartridge has been depleted or when a print head becomes defective, the carriage 51 is moved to a parking station location, indicated by reference 65, located beyond the print station. A blade 66 is located at the parking station 65. The blade is secured to a chassis (not shown) of the printing apparatus of the postage meter and extends parallel to the direction of translational movement of the carriage 51. When the carriage is moved toward the parking station, a cammed finger 67 on the member 60 is engaged by an end 68 of the blade and this engagement causes the member 60 to be pivoted in the direction of arrow 62 and thereby disengage the second set of electrical contacts on the ribbon cable from the first set of electrical contacts of the print head cartridge. On further movement of the carriage into the parking station location the blade 56 enters between the receptacle 52 and the second set of contacts carried on the member 60. Therefore the blade extends across the aperture 58 of the carriage and, since the member and the second set of electrical contacts are located beyond the blade relative to the aperture 58, access through the aperture 58 to the second set of contacts is prevented.

Figure 3:
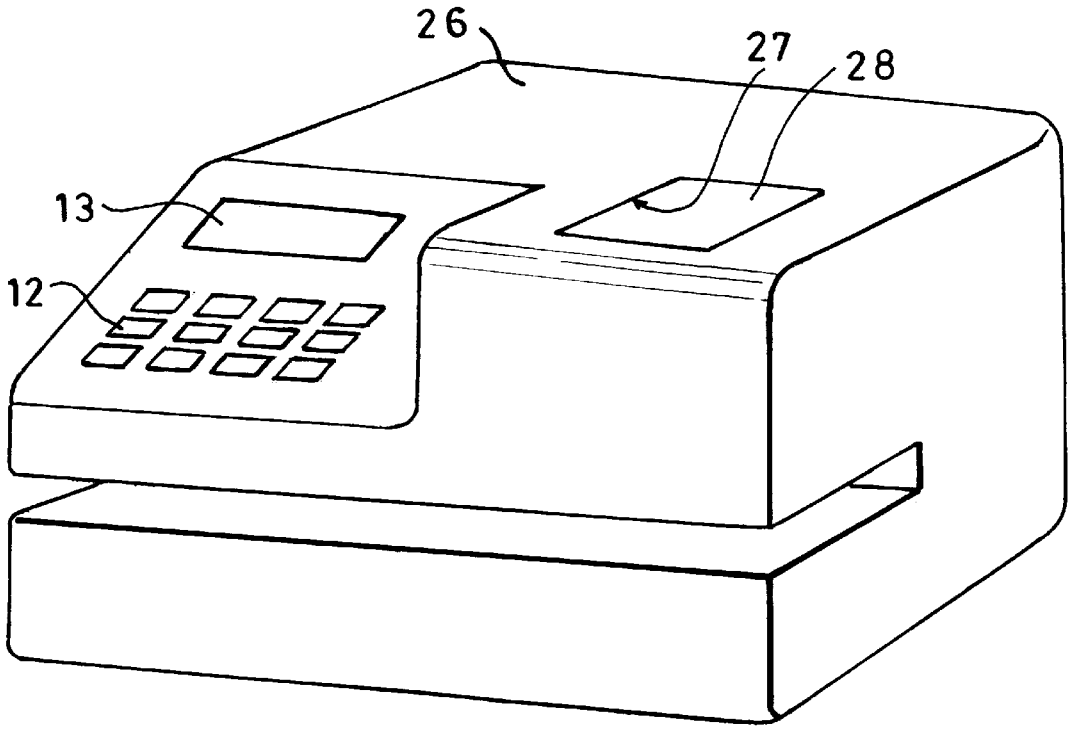
FIG. 3 illustrates a postage meter provided with an access in the housing thereof to the print head module.

As described with reference to FIG. 3, the printing apparatus together with the electronic circuits of the postage meter are housed in a secure housing 26. The housing is provided with an access aperture indicated by broken line 27 aligned with the parking station to permit removal of the used cartridge from the carriage and insertion of a replacement cartridge into the carriage and a door or shutter 28 is provided to close the access aperture. Normally the door or shutter is closed but when the carriage is moved to the parking station, the door or shutter may be opened to provide access to the print head cartridge through the access aperture 27. It will be appreciated that, when the carriage is aligned with the access aperture to permit removal and insertion of a cartridge, the second set of electrical contacts carried by the member 60 lie behind the blade 66, relative to the access aperture, and hence access to these contacts is prevented.

Figure 4:
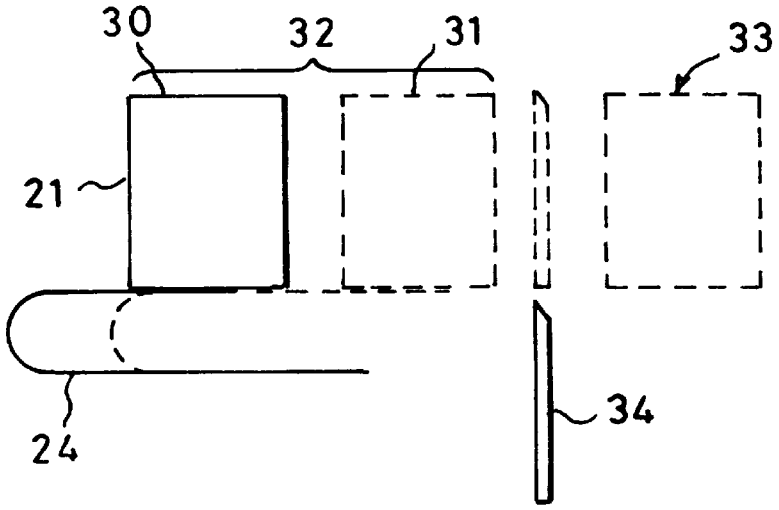
FIG. 4 is schematic illustration of means for maintaining security of the print head when in an operative location.

A shutter as referred to hereinbefore in relation to FIG. 4, but not shown in FIG. 5 is secured to or operated in conjunction with the door for the access aperture 27. The shutter normally lies out of the path of travel of the carriage so that the carriage is free to move along the guide rod between the print operation range of movement and the parking station location. However when the door for the access aperture is opened the shutter is thereby moved into a position such that it acts as a dividing wall between the printing station and the parking station. Accordingly any attempt to obtain access to the carriage, the cartridge and the electrical connections thereto when the carriage and the print head cartridge carried thereby are in the printing station will be blocked and prevented by the shutter. When the carriage has been moved into the parking station, the shutter together with the blade prevent access to the second set of electrical contacts and the ribbon cable connections to the postage meter.

It will be understood that the term parking station used hereinbefore refers to a location at which the print head cartridge may be removed and a new replacement cartridge inserted. Accordingly it will be appreciated that while the print head cartridge is located at this parking station there is no requirement for electrical connections between the print head cartridge and electrical circuits which control operation of and apply electrical power to the print head cartridge.

Hereinbefore, the print head has been described as being transported across a print receiving area of the mail item, the mail item being stationery during the printing operation. However if desired the mail item may be fed past the print head and head cartridge transport means are provided to move the print head between printing and parking stations.

Hereinbefore a system providing only access permitting replacement of a print head module has been described. However if desired the access may be in respect of other components or functions of the postage meter. Accordingly reference to replacement of a print head module is to be understood as including other components of the postage meter.

We claim:

1. Secure printing apparatus including a printing device removable by a user of the secure printing apparatus; a printing station in which the printing device is located to effect printing of indicia on a print receiving medium; electrical contacts on the printing device; electrical connection means interfacing with said electrical contacts on the printing device when the printing device is mounted in the secure printing apparatus and is located in said printing station; means to locate the printing device in a parking station at which said electrical connection means are disengaged from said electrical contacts; said printing device being removable by a user of the secure printing apparatus when said printing device is located in said parking station and means isolating said parking station from said electrical connection means.

2. Secure printing apparatus as claimed in claim 1 wherein the printing device is movable in the printing station to effect a printing operation and electrical connection means are movable with the printing device in the printing station and including means to retain the electrical connection means at the printing station when the printing device is moved to the parking station.

3. Secure printing apparatus as claimed in claim 2 wherein the printing device travels along a non-straight line path in moving between the printing station and the parking station.

4. Secure printing apparatus as claimed in claim 1 wherein the means isolating the parking station from the electrical connection means includes a shutter movable into a location intermediate the parking station and the printing station.

5. Secure printing apparatus as claimed in claim 1 wherein the printing device comprises an ink jet printer.

6. Secure printing apparatus as claimed in claim 1 wherein the printing device is housed in a secure housing of the secure printing apparatus and an access aperture is provided in the secure housing adjacent the parking station to provide access for removal and insertion of the printing device.

7. Secure printing apparatus as claimed in claim 6 including a closure member to close the aperture in the secure housing.

8. Secure printing apparatus as claimed in claim 7 including interlock means to prevent movement of the printing device from the parking station to the printing station when the aperture is not closed by the closure member.

9. Secure printing apparatus as claimed in claim 7 including severing means located adjacent the closure means and operative upon closing of the closure means to sever any electrical connections extending through the aperture.

10. Secure printing apparatus as claimed in claim 1 including electronic circuits operable to carry out accounting functions and to control the printing device to print postage indicia on mail items.

11. Secure printing apparatus including a printing station and a parking station; a print head mounted on a carriage movable between the printing station and the parking station; a first set of electrical contacts on said print head; first means on and movable with said carriage supporting a second set of electrical contacts in electrical engagement with said first set of contacts; and second means operative when the carriage is moved from the printing station to the parking station to act on the first means such as to break the electrical engagement of the second set of electrical contacts with the first set of electrical contacts and said second means extending across the second set of electrical contacts to prevent access to said second set of electrical contacts.

12. Secure printing apparatus as claimed in claim 11 wherein the first means includes a member pivotally mounted relative to the carriage.

13. Secure printing apparatus as claimed in claim 12 wherein the second means includes a stationary planar element.

14. Secure printing apparatus as claimed in claim 11 wherein the print head is an ink jet print head removably mounted on the carriage.

15. Secure printing apparatus as claimed in claim 14 wherein the printing apparatus is housed in a housing with an access aperture in a wall of the housing aligned with the parking station whereby removal of the print head from the carriage and insertion of the print head into the carriage can be effected only when the carriage is at the parking station.

16. Secure printing apparatus as claimed in claim 15 including a door or shutter normally closing the access aperture and openable to provide access to the print head when the carriage is in the parking station.

17. Secure printing apparatus as claimed in claim 16 including shroud means operable by opening of the door or shutter to prevent access from the access aperture to the print head and to the sets of electrical contacts when the carriage is in the printing station.

18. Secure printing apparatus as claimed in claim 11 including electronic circuits operable to carry out accounting functions and to control the print head to print postage indicia on mail items.

* * * * *